US007501998B2

(12) United States Patent
Heo

(10) Patent No.: US 7,501,998 B2
(45) Date of Patent: Mar. 10, 2009

(54) PLASMA DISPLAY DEVICE AND PLASMA DISPLAY PANEL DRIVING METHOD

(75) Inventor: Eun-Gi Heo, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 628 days.

(21) Appl. No.: 10/954,414

(22) Filed: Sep. 29, 2004

(65) Prior Publication Data

US 2005/0088371 A1 Apr. 28, 2005

(30) Foreign Application Priority Data

Oct. 24, 2003 (KR) ..... 10-2003-0074641

(51) Int. Cl.
*G09G 3/28* (2006.01)

(52) U.S. Cl. ..... 345/66; 345/60; 345/63

(58) Field of Classification Search ..... 345/60–69, 345/204, 211, 690
See application file for complete search history.

(56) References Cited

U.S. PATENT DOCUMENTS 6,906,689 B2 * 6/2005 Lee et al. ..... 345/60
7,129,912 B2 * 10/2006 Otani et al. ..... 345/66

FOREIGN PATENT DOCUMENTS

CN 1280353 A 1/2001
JP 2002-14652 1/2002
KR 2001-0004123 1/2001

OTHER PUBLICATIONS

Amemiya, et al., "Improvement of Contrast Ratio in Co-Planar Structured AC-Plasma Display Panels by Confined Discharge near the Electrode Gap," International Display Workshops (IDW '97) PDP2-3, pp. 523-526.
Amemiya, et al., "High Luminous Efficiency and High Definition Coplanar AC-PDP with "T"-shaped Electrodes," International Display Workshops (IDW '98 ) PDP4-2, pp. 531-534.
Patent Abstracts of Japan for Publication No. 2002-014652; Date of publication of application: Jan. 18, 2002, in the name of Kenji Ogawa et al.
Korean Patent Abstracts for Publication No. 1020010004123; Date of publication of application Jan. 15, 2001, in the name of Gyu Hwan Lim et al.
English Translation of Abstract for China Publication No. 1280353 A; Date of publication of application Jan. 17, 2001, in the name of Dong Cheol Jung.

* cited by examiner

*Primary Examiner*—Duc Q Dinh
(74) *Attorney, Agent, or Firm*—Christie, Parker & Hale, LLP

(57) ABSTRACT

A plasma display panel (PDP) that has a T-shaped electronic structure or an electrode structure with adjacent parts of the scan electrode and the sustain electrode being broad, and parts coupled to the bus electrodes being narrow in a like manner to the T-shaped electrode structure is provided. The PDP has various discharge modes according to magnitudes of sustain discharge voltages. A frame is divided into a plurality of subfields with respective weights and is driven in the PDP. The subfields with low weights use low sustain discharge voltages to perform a discharge with a small quantity of emitting light, and the subfields with high weights use high sustain discharge voltages to perform a discharge with a big quantity of emitting light, thereby increasing representation performance of low gray scales.

9 Claims, 5 Drawing Sheets

PLASMA DISPLAY DEVICE AND PLASMA DISPLAY PANEL DRIVING METHOD

CROSS REFERENCE TO RELATED APPLICATION

This application claims priority to and the benefit of Korea Patent Application No. 2003-74641 filed on Oct. 24, 2003 in the Korean Intellectual Property Office, the entire content of which is incorporated herein by reference.

BACKGROUND OF THE INVENTION (a) Field of the Invention

The present invention relates to a plasma display device and a plasma display panel (PDP) driving method.

(b) Description of the Related Art

A PDP is a flat display that uses plasma generated via a gas discharge process to display characters or images. Depending on its size, the PDP can include tens to millions of pixels that are provided thereon in a matrix format. According to the supplied driving voltage waveforms and discharge cell structures, PDPs can be categorized into direct current (DC) PDPs and alternating current (AC) PDPs.

Since the DC PDPs have electrodes exposed in the discharge space, they allow a current to flow in the discharge space while the voltage is supplied, and therefore they are problematic in that they require resistors for current restriction. On the other hand, since the AC PDPs have electrodes covered by a dielectric layer, capacitances are naturally formed to restrict the current, and the electrodes are protected from ion shocks in the case of discharging. Accordingly, the AC PDPs have a longer lifespan than the DC PDPs.

FIG. 1 shows a perspective view of an AC PDP.

As shown in FIG. 1, scan electrodes 4 and sustain electrodes 5 are disposed over a dielectric layer 2 and a protection film 3. The scan electrodes 4 and the sustain electrodes 5 in pairs are formed in parallel and are under a first glass substrate 1. A plurality of address electrodes 8 covered with an insulation layer 7 are installed on a second glass substrate 6. Barrier ribs 9 are formed on the insulation layer 7, between the address electrodes 8, and in parallel with the address electrodes 8. Phosphors 10 are formed on the surface of the insulation layer 7 and between the barrier ribs 9. The first and second glass substrates 1 and 6 are provided facing each other with discharge spaces between them 1 and 6 so that the scan electrodes 4 and the sustain electrodes 5 can cross the address electrodes 8. A discharge space 11 between an address electrode of the address electrodes 8 and a crossing part of a pair of the scan electrodes 4 and the sustain electrodes 5 form a discharge cell 12, which is schematically indicated.

FIG. 2 shows a PDP electrode arrangement diagram.

As shown in FIG. 2, the PDP electrodes have an m×n matrix configuration. Address electrodes A1 to Am are arranged in a column direction, and scan electrodes Y1 to Yn and sustain electrodes X1 to Xn are alternately arranged in a row direction. The discharge cell 12 shown in FIG. 2 substantially corresponds to the discharge cell 12 shown in FIG. 1.

In general, a frame is divided into a plurality of subfields with respective weights and is driven in an AC PDP. For example, 256 gray scales can be represented through combination of eight subfields with the weights of 1, 2, 4, 8, 16, 32, 64, and 128. In this instance, each subfield includes a reset period, an address period, a sustain period, and an erase period in a temporal operation variation manner.

In the reset period, the states of the respective cells are reset in order to smoothly address the cells. In the addressing period, the cells that are turned on and the cells that are not turned on in a panel are selected, and wall charges are accumulated to the cells that are turned on (i.e., the addressed cells). In the sustain period, discharge is performed in order to actually display pictures on the addressed cells.

Recently, because of high efficiency of the PDPs, a magnitude of a quantity of light displayed by a discharge, i.e. brightness, has increased. In the case of displaying the gray scale of 0, a low quantity of light generated in the reset period is provided. In the case of displaying the gray scale of 1, a quantity of light generated in the address period and a quantity of light generated by sustain discharge pulses in the sustain period are provided in addition to the quantity of light generated in the reset period. Since the difference of brightness between the gray scales of 0 and 1 (i.e., a minimum unit of difference in brightness) is increased because of summation of the quantities of light in the address period and the sustain period, performance of low gray representation (e.g., representation having lower brightness) is restricted and/or degraded.

SUMMARY OF THE INVENTION

An aspect of the present invention provides a plasma display device with excellent performance of low gray representation, and a PDP driving method to facilitate the same.

In another aspect of the present invention, a low sustain discharge voltage is used in a subfield with a low weight.

In an exemplary embodiment according to the present invention, a plasma display device includes a PDP having a first electrode and a second electrode forming a discharge cell and a driver for dividing a frame into a plurality of subfields having respective weights, driving them, and alternately applying sustain discharge pulses to the first and second electrodes in a sustain period. The subfields are divided into at least two groups. A first voltage of a first sustain discharge pulse of a first subfield of the subfields belonging to a first group of the at least two groups. The first group includes at least the subfield having the lowest weight in the sustain period. The first voltage is less than a second voltage of a second sustain discharge pulse of a second subfield belonging to a second group of the at least two groups in the sustain period.

The difference between the second voltage and the first voltage may be greater than 5V (volts).

The first electrode may include a first bus electrode provided in a predetermined direction and a first discharge electrode formed in the discharge cell and coupled to the first bus electrode. The second electrode may include a second bus electrode provided in a predetermined direction and a second discharge electrode formed in the discharge cell and coupled to the second bus electrode. In addition, the plasma display device may include a first region at which a discharge is spread at the first and second discharge electrodes by the first sustain discharge pulse of the first voltage. The first region may be narrower than a second region at which a discharge is spread at the first and second discharge electrodes by the second sustain discharge pulse of the second voltage.

The first discharge electrode may include a third region formed within the discharge cell and a fourth region for coupling the third region and the first bus electrode. The second discharge electrode may include a fifth region formed within the discharge cell and a sixth region for coupling the fifth region and the second bus electrode. In addition, the second region may include at least part of the fourth and sixth regions.

The first region may include at least part of the third and fifth regions, and the second region may further include the third and fifth regions.

The discharge mode by the sustain discharge pulse of the first voltage may be different from the discharge mode by the sustain discharge pulse of the second voltage.

A width of the fourth region toward the direction of the first bus electrode may be narrower than a length of the third region toward the direction of the first bus electrode.

The PDP further may include address electrodes arranged to cross the first and second bus electrodes.

In another exemplary embodiment according to the present invention, a method for dividing a frame into a plurality of subfields and driving them in a PDP including first electrodes and second electrodes forming discharge cells is provided. The PDP driving method includes selecting a first discharge cell to be turned on from among the discharge cells in a first subfield of the subfields, sustain-discharging the selected first discharge cell in the first subfield and selecting a second discharge cell to be turned on from among the discharge cells in a second subfield of the subfields. The second subfield has a weight different from that of the first subfield. In addition, the method includes sustain-discharging the selected second discharge cell in the second subfield. In the present method, a discharge mode for generating a sustain discharge in the first subfield is different from a discharge mode for generating a sustain discharge in the second subfield.

In still another exemplary embodiment according to the present invention, a plasma display device includes a PDP. The PDP has a first electrode and a second electrode forming a discharge cell. The display device also includes a driver for dividing a frame into a plurality of subfields having respective weights, driving them, and alternately applying sustain discharge pulses to the first and second electrodes in a sustain period. The first electrode includes a first bus electrode arranged in a predetermined direction, a first region formed within the discharge cell, and a second region for coupling the first region and the first bus electrode. The second electrode includes a second bus electrode arranged in a predetermined direction, a third region formed within the discharge cell, and a fourth region for coupling the third region and the second bus electrode. A width of the second region toward the direction of the first bus electrode being narrower than a length of the first region toward the direction of the first bus electrode, and the voltage of the sustain discharge pulse in at least one subfield is different from the voltage of the sustain discharge pulse in another subfield.

BRIEF DESCRIPTION OF THE DRAWINGS

The accompanying drawings, together with the specification, illustrate exemplary embodiment(s) of the present invention, and, together with the description, serve to explain the principles of the present invention.

DETAILED DESCRIPTION

In the following detailed description, only certain exemplary embodiment(s) of the present invention are shown and described, simply by way of illustration. As those skilled in the art would realize, the described embodiment may be modified in various different ways, all without departing from the spirit or scope of the present invention. Accordingly, the drawings and description are to be regarded as illustrative in nature, and not restrictive.

Figure 3:
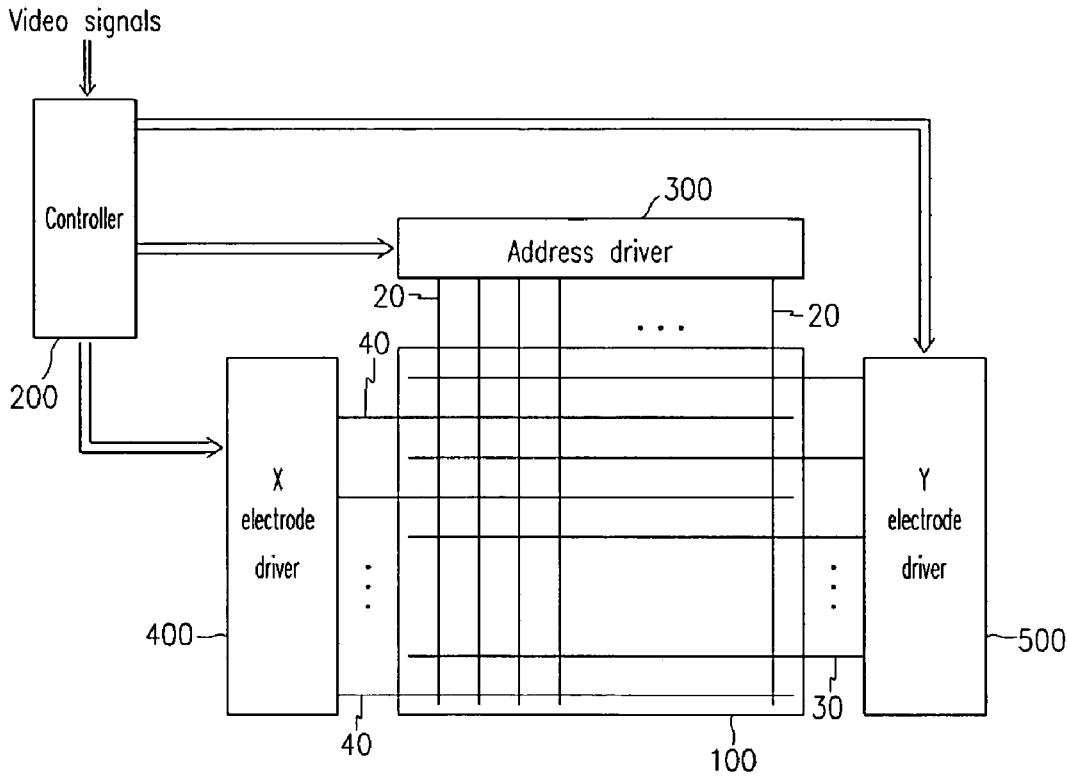
FIG. 3 shows a brief conceptual diagram of a plasma display device according to an exemplary embodiment of the present invention.

FIG. 3 shows a brief conceptual diagram of a plasma display device according to an exemplary embodiment of the present invention.

As shown in FIG. 3, the plasma display device includes a PDP 100, a controller 200, an address driver 300, an X (or sustain) electrode driver 400, and a Y (or scan) electrode driver 500. The X electrode driver 400 and the Y electrode driver 500 are separately provided in FIG. 3, but they can also be combined into a single unit.

The PDP 100 includes a plurality of address electrodes 20 provided in the vertical direction, and scan electrodes 30 and sustain electrodes 40 provided in pairs in the horizontal direction. The address driver 300 receives an address drive control signal from the controller 200, and applies address signals for selecting discharge cells to be displayed to the respective address electrodes 20. The Y and X electrode drivers 500 and 400 respectively receive sustain control signals from the controller 200, and input sustain discharge pulses to the scan electrodes 30 and the sustain electrodes 40 to sustain the selected discharge cells. In this instance, the sustain discharge pulses represent waveforms alternately applied to the scan electrodes 30 and sustain electrodes 40 during the sustain period, and a voltage of the sustain discharge pulse represents a difference of between the voltages applied to the scan electrodes 30 and the sustain electrodes 40. The controller 200 receives external image signals, generates an address drive control signal and a sustain discharge control signal, and applies them to the address driver 300 and the Y and X electrode drivers 500 and 400.

The PDP 100 has two discharge modes according to a voltage of the sustain discharge pulse applied to one of the scan electrode and the sustain electrode during the sustain period. That is, the PDP 100 performs a low brightness discharge when the voltage of the applied sustain discharge pulse is low, and performs a high brightness discharge when the voltage of the applied sustain discharge pulse is high. A PDP (e.g., the above-noted PDP 100) will be described in detail with reference to FIGS. 4 and 5.

Figure 4:
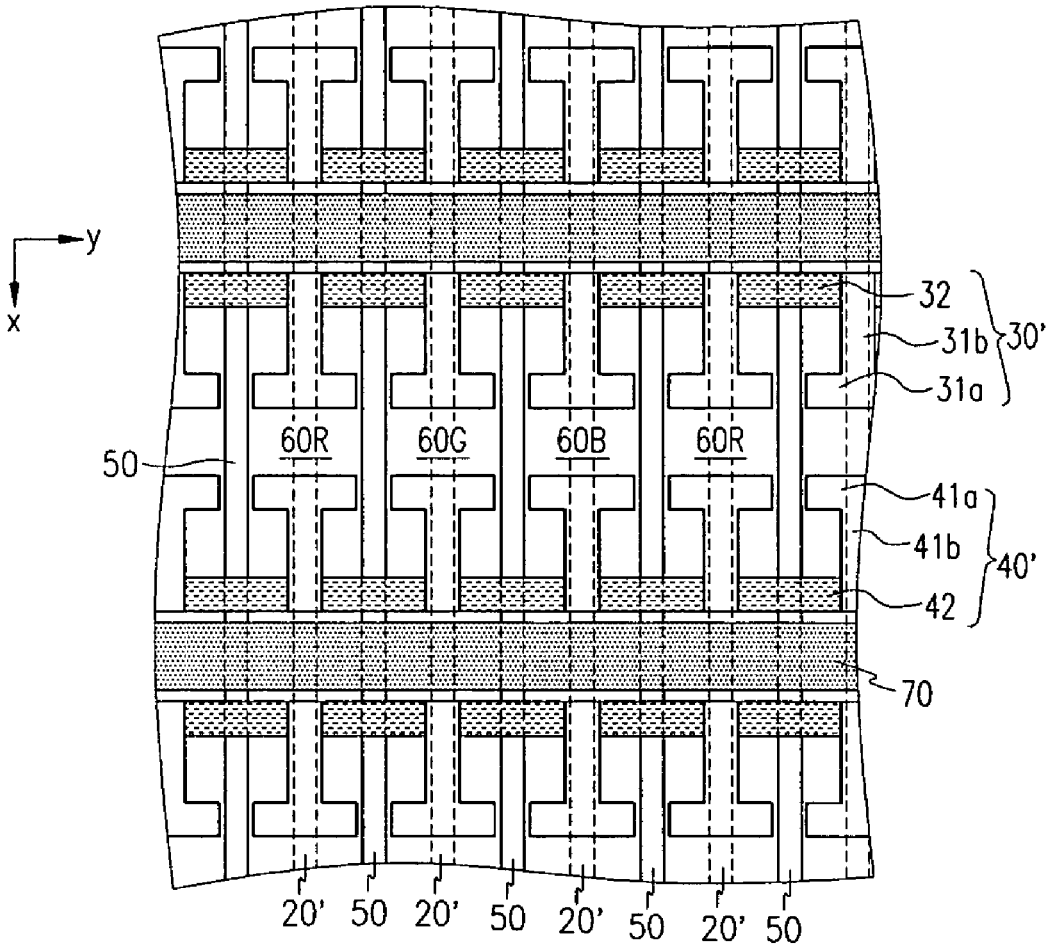
FIG. 4 shows a partial plane view of a PDP according to an exemplary embodiment of the present invention.

FIG. 4 shows a partial plan view of a PDP according to a first exemplary embodiment of the present invention.

Figure 1:
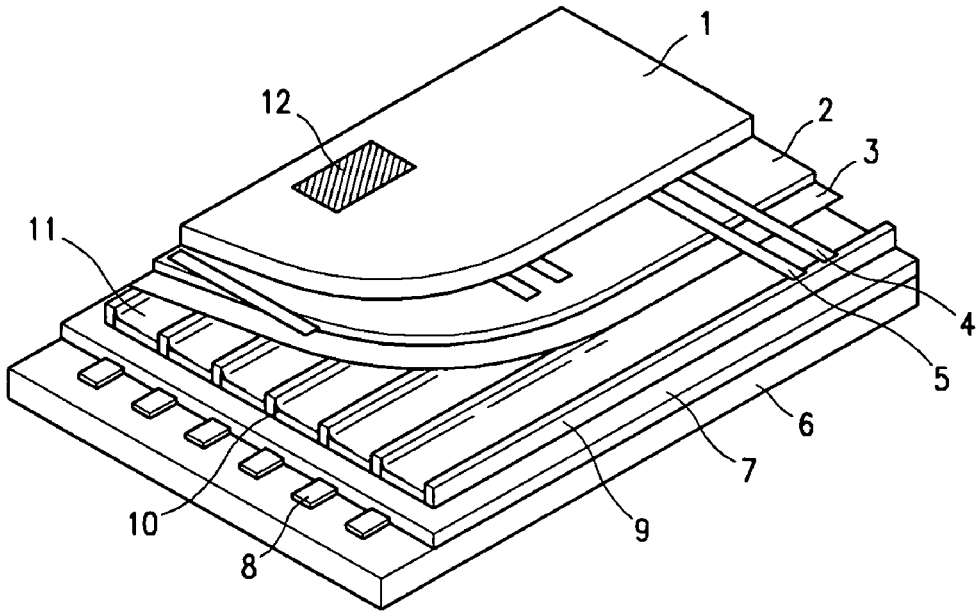
FIG. 1 shows a partial perspective view of an AC PDP.
Figure 2:
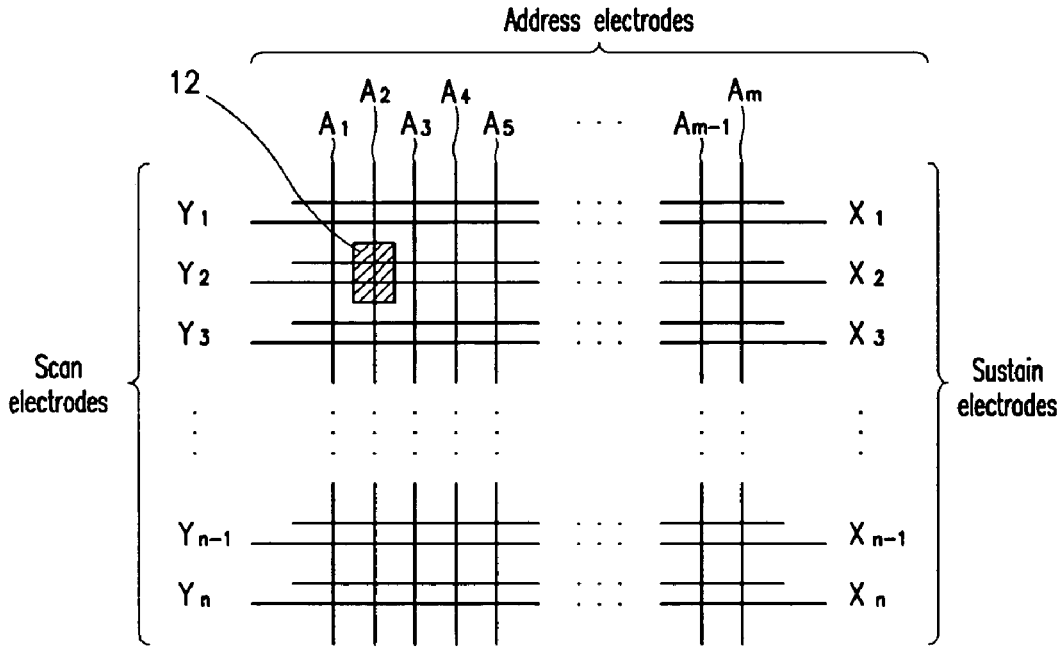
FIG. 2 shows a PDP electrode arrangement diagram.

As shown in FIG. 4, the PDP includes a rear substrate (e.g., the substrate 6 of FIG. 1) and a front substrate (e.g., the substrate 1 of FIG. 1) facing each other. A plurality of address electrodes 20' are vertically (in the y direction in FIG. 4) formed on the rear substrate, and a plurality of scan electrodes 30' and sustain electrodes 40' are horizontally (in the x direction in FIG. 4) formed on the front substrate.

A plurality of barrier ribs 50 are formed in the space between the rear substrate and the front substrate, and are formed in parallel to the address electrodes 20' between two adjacent address electrodes 20'. A space formed by two adjacent barrier ribs 50 and the adjacent scan electrode 30' and the sustain electrode 40' forms discharge cells 60R, 60G, and 60B.

The scan electrode 30' and the sustain electrode 40' respectively include transparent electrodes 31 and 41 for generating a discharge in the discharge cells 60R, 60G, and 60B. The scan electrode 30 and the sustain electrode 40 are also respectively coupled to bus electrodes 32 and 42 for compensating high resistance of the transparent electrodes 31 and 41 and obtaining conductivity. In general, the transparent electrodes 31 and 41 can be realized with indium tin oxide (ITO) electrodes, and the bus electrodes 32 and 42 can be realized with metallic electrodes. The scope of the present invention, however, is not limited to the types of electrodes. Instead, all or some of the electrodes can be replaced by any suitable conductive and/or semi-conductive electrodes as would be recognized by those skilled in the art. The transparent electrodes 31 and 41 are protruded at the bus electrodes 32 and 42 into the discharge cells 60R, 60G, and 60B, facing each other. Also, the transparent electrodes 31 and 41 comprise horizontal units 31*a* and 41*a* provided in the horizontal direction, and vertical units 31*b* and 41*b* provided in the vertical direction to couple the centers of the horizontal units 31*a* and 41*a* and the bus electrodes 32 and 42. That is, the transparent electrodes 31 and 41 have T shapes which have long facing parts and narrow parts coupled to the bus electrodes 32 and 42.

As also shown in FIG. 4, black stripes 70 for improving the contrast can be formed at regions where the adjacent scan electrodes 30' and the sustain electrodes 40' are formed outside the discharge cells 60R, 60G, and 60B.

The configuration of the PDP according to the first exemplary embodiment of the present invention has been described above, and discharge characteristics of the PDP will now be described.

A paper in the International Display Workshops (IDW '97), entitled "Improvement of contrast ratio in coplanar structured AC-plasma display panels by confined discharge near the electrode gap" by Kimio Amemiya and Takashi Nishio discloses that the sustain discharge characteristics are varied at a low voltage of Vsm near the minimum voltage for a sustain discharge and at a high voltage near a discharge firing voltage. That is, when a high voltage is used as a voltage for a sustain discharge in the sustain period, a discharge is generated at the gap of the transparent electrodes 31 and 41 of the scan electrode 30 and the sustain electrode 40, and it is spread toward the bus electrodes 32 and 42 moving along the transparent electrodes 31 and 41. When a low voltage is used as a voltage for a sustain discharge, a discharge is generated at the gap of the transparent electrodes 31 and 41 of the scan electrode 30 and the sustain electrode 40, and it is not spread.

Another paper in the International Display Workshops (IDW '98), entitled "High luminous efficiency and high definition coplanar AC-PDP with T-shaped electrodes" by Kimio Amemiya, Toshihiro Komaki, and Takashi Nishio discloses the above-described phenomena in the PDP with a T-shaped electrode structure as shown in FIG. 4. In detail, when a low voltage is used for the T-shaped electrode, the discharge is only generated near the gap (31*a* and 41*a* of FIG. 4) of the transparent electrodes 31 and 41, and when a high voltage is used, the discharge is spread following the transparent electrodes 31 and 41.

Figure 5:
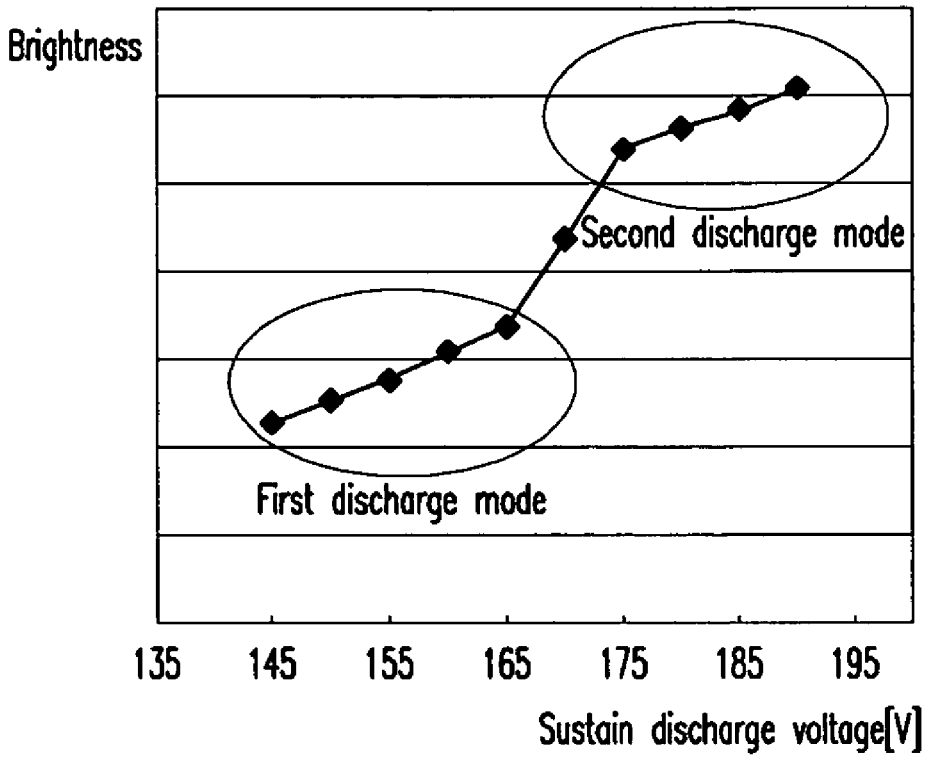
FIG. 5 shows brightness of sustain discharge pulses with respect to voltages in the PDP of FIG. 4.

Accordingly, the light emitting brightness caused by a sustain discharge pulse is low when the discharge is generated at the gap of the transparent electrodes 31 and 41 and does not spread, and the brightness is high when the discharge is spread through the transparent electrodes 31 and 41. FIG. 5 shows brightness of sustain discharge pulses with respect to voltages in the PDP of FIG. 4.

As shown in FIG. 5, the brightness according to the discharge of the PDP is varied depending on the voltage of the sustain discharge pulses. In particular, when the voltage of the sustain discharge pulse is less than 165V, a first discharge mode which has relatively low brightness characteristic is formed, and when the voltage of the sustain discharge pulse is greater than 175V, a second discharge mode which has relatively high brightness characteristic is formed. The brightness characteristics of the first and second discharge modes are not greatly varied when the voltage is changed. Also, the brightness is greatly varied at the voltage of between the first and second discharge modes according to voltage variation, and in particular, the brightness is greatly varied by 5V-voltage variations as shown in FIG. 5.

The brightness is changed according to the voltage of the sustain discharge pulse in the PDP, and the T-shaped electrode structure of FIG. 4 has a plurality of discharge modes which have different brightness characteristics according to voltages. The above-described structure is well exemplified in the electrode structure wherein adjacent parts of the scan electrode 30' and the sustain electrode 40' are broad, and parts coupled to the bus electrodes 32 and 42 are narrow in a like manner of the T-shaped electrode structure of FIG. 4.

A method for increasing representation performance of low gray scales by using characteristics of the PDP according to the first exemplary embodiment of the present invention will now be described.

Figure 6:
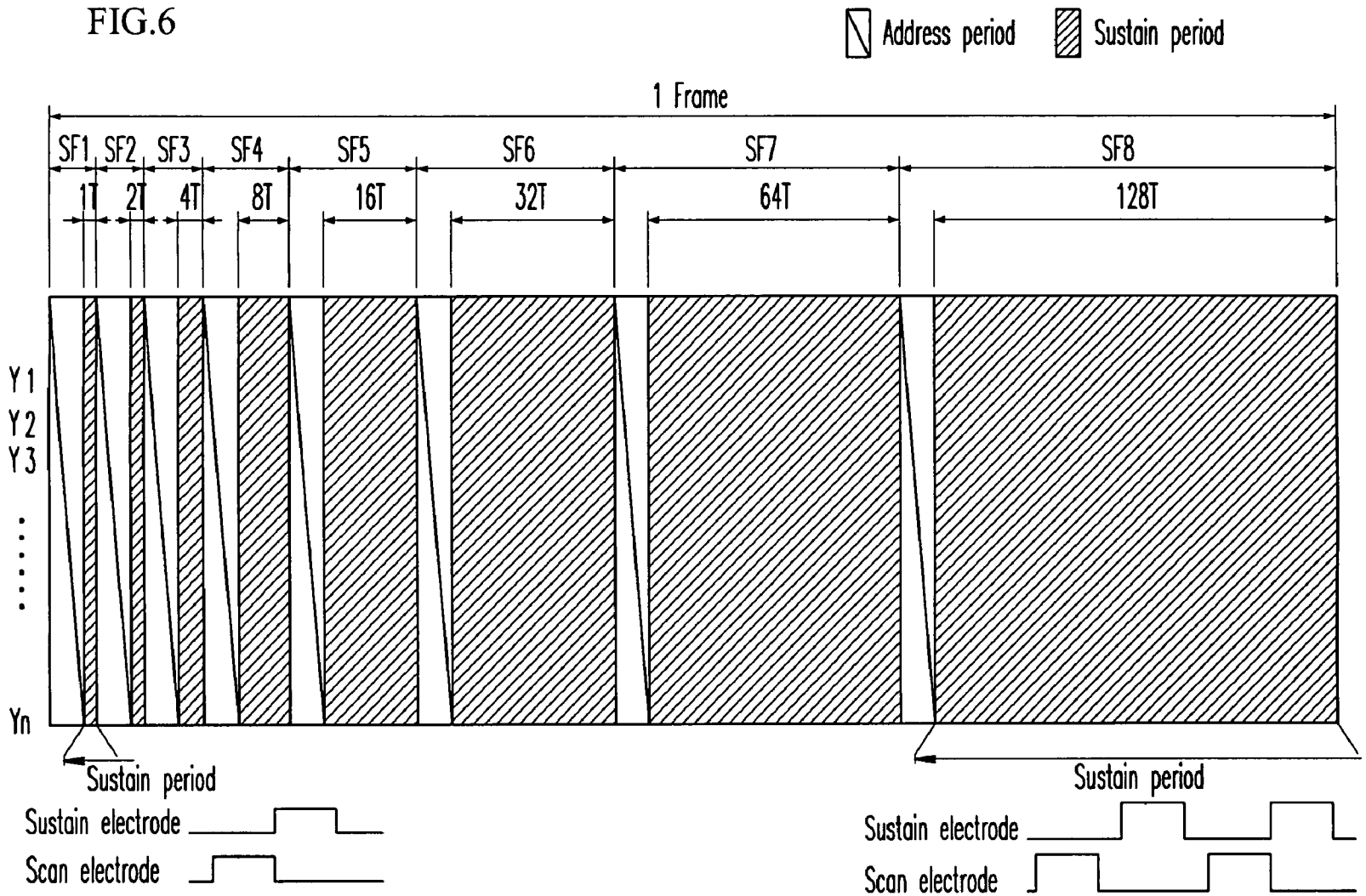
FIG. 6 shows driving waveforms of a PDP according to an exemplary embodiment of the present invention.

One frame is divided into a plurality of subfields SF1 to SFn and is then driven, in the PDP according to the first exemplary embodiment of the present invention. The respective subfields SF1 to SFn have weights W1 to Wn (where W1≦W2≦. . . ≦Wn), and the number of sustain discharge pulses during the sustain period of the respective subfields SF1 to SFn is determined by the weight. The gray scales are represented in proportion to summation of the weights of the subfields at which the sustain discharge is performed. For example, referring to FIG. 6, 256 gray scales are represented by dividing one frame into eight subfields SF1 to SF8, and establishing the weights W1 to Wn of the subfields SF1 to SF8 as 1, 2, 4, 8, 16, 32, 64, and 128.

The quantity of emitting light displayed by the subfield SF1 with the lowest weight has been increased because of high efficiency of the PDP. Therefore, the voltage of the sustain discharge pulse of the subfield SF1 with the lowest weight is established to be a voltage for representing the brightness of the first discharge mode, and the voltages of the sustain discharge pulses of the residual subfields SF2 to SF8 are established to be voltages for representing the brightness of the second discharge mode. As a result, the brightness difference of between the grays of 0 and 1 is reduced since the quantity of light during the sustain period is reduced when representing the gray of 1.

The voltage of the sustain discharge pulse of the subfield SF1 with the lowest weight is established to be a voltage for representing the brightness of the first discharge mode in the first exemplary embodiment, and in addition, the voltages of the sustain discharge pulses of a predetermined number of subfields SF1 and SF2 with low weights can be established to be voltages for representing the brightness of the first discharge mode. That is, a predetermined number of subfields with low weights are defined to be a group, other subfields are defined to be another group, and sustain voltages of the groups are established to be different. Accordingly, representation performance in the low gray scales becomes better because of the brightness difference between the grays of 1 and 2 compared to the first exemplary embodiment. When the voltages of the sustain discharge pulses of all the subfields are established as the above-noted voltage, the overall brightness is reduced, and an appropriate number of subfields can be selected according to the representation performance of low gray scales required by panel characteristics.

The sustain discharge is performed on the subfield with low weights in the first discharge mode of FIG. 5, and the sustain discharge is performed on the subfield with high weights in the second discharge mode of FIG. 5, and differing from this, another discharge mode is possible. That is, a sustain discharge may be performed on the subfield with a low weight in the discharge mode of between the first and second discharge modes. Hence, the brightness difference of between the grays of 0 and 1 is increased compared to the first exemplary embodiment, but the above method can be applicable to a panel which requires representation performance of a low gray scale lower than the first exemplary embodiment. For example, when the voltage of the sustain discharge pulse of the subfield SF1 is established to be 170V, and the voltages of the sustain discharge pulses of the subfields SF2 to SFn are established to be 175V, the representation performance of a low gray scale is increased since the brightness difference caused by the sustain discharge pulse becomes manifest as shown in FIG. 5.

Also, the PDP having the T-shaped electrode structure has been described in the first exemplary embodiment. However, the present invention is not limited to the first exemplary embodiment, and can be applied to all the electrode structures which substantially have the above-described discharge modes of the T-shaped electrode structure shown in FIG. 4. One example thereof is an electrode structure in which a region where transparent electrodes of the scan electrode and the sustain electrode is broad and a region coupled to the bus electrode is narrow.

As described, the characteristics of different discharge modes according to voltages of the sustain discharge pulses in the PDP are used, in which a low sustain discharge voltage is used in the low subfield and a high sustain discharge voltage is used in the high subfield, and accordingly, the representation performance of low gray scales is enhanced.

While this invention has been described in connection with certain exemplary embodiment(s), it is to be understood that the invention is not limited to the disclosed embodiment(s), but, on the contrary, is intended to cover various modifications included within the spirit and scope of the appended claims and equivalents thereof.

What is claimed is:

1. A plasma display device comprising:

a plasma display panel including a first electrode and a second electrode forming a discharge cell;

a driver for dividing a frame into a plurality of subfields having respective weights, driving the plurality of subfields, and alternately applying sustain discharge pulses to the first and second electrodes in a sustain period, wherein the subfields are divided into at least two groups; and a first voltage of a first sustain discharge pulse of a first subfield of the subfields belonging to a first group of the at least two groups, the first group including at least the subfield having the lowest weight in the sustain period, wherein the first voltage is less than a second voltage of a second sustain discharge pulse of a second subfield belonging to a second group of the at least two groups in the sustain period, wherein the first electrode comprises a first bus electrode and a first discharge electrode formed in the discharge cell and coupled to the first bus electrode, the second electrode comprises a second bus electrode and a second discharge electrode formed in the discharge cell and coupled to the second bus electrode, and a first region at which a discharge is spread at the first and second discharge electrodes by the first sustain discharge pulse of the first voltage is narrower than a second region at which a discharge is spread at the first and second discharge electrodes by the second sustain discharge pulse of the second voltage; and wherein the first discharge electrode includes a third region formed within the discharge cell and a fourth region for coupling the third region and the first bus electrode, the second discharge electrode includes a fifth region formed within the discharge cell and a sixth region for coupling the fifth region and the second bus electrode, and the second region includes at least part of the fourth and sixth regions.

2. The plasma display device of claim 1, wherein the difference between the second voltage and the first voltage is greater than 5V (volts).

3. The plasma display device of claim 1, wherein the first region includes at least part of the third and fifth regions and wherein the second region further includes the third and fifth regions.

4. The plasma display device of claim 1, wherein a width of the fourth region toward the direction of the first bus electrode is narrower than a length of the third region toward the direction of the first bus electrode.

5. The plasma display device of claim 1, wherein the plasma display panel further comprises address electrodes arranged to cross the first and second bus electrodes.

6. The plasma display device of claim 1, wherein a discharge mode by the first sustain discharge pulse of the first voltage is different from a discharge mode by the second sustain discharge pulse of the second voltage.

7. A method for dividing a frame into a plurality of subfields and driving the plurality of subfields in a plasma display panel including first electrodes and second electrodes forming discharge cells, the method comprising:

selecting a first discharge cell to be turned on from among the discharge cells in a first subfield of the plurality of subfields;

sustain-discharging the selected discharge cell in the first subfield;

selecting a second discharge cell to be turned on from among the discharge cells in a second subfield of the plurality of subfields, wherein the second subfield has a weight different from that of the first subfield; and sustain-discharging the selected second discharge cell in the second subfield, wherein a discharge mode for generating a sustain discharge in the first subfield is different from a discharge mode for generating a sustain discharge in the second subfield, wherein the first electrode comprises a first bus electrode, a first region formed within the discharge cell, and a second region for coupling the first region and the first bus electrode, and the second electrode comprises a second bus electrode, a third region formed within the discharge cell, and a fourth region for coupling the third region and the second bus electrode; and wherein a width of the second region toward the direction of the first bus electrode is narrower than a length of the first region toward the direction of the first bus electrode, and wherein a first voltage for sustain-discharging the first discharge cell in the first subfield is less than a second voltage for sustain-discharging the second discharge cell in the second subfield.

8. The method of claim 7, wherein the difference between the first voltage and the second voltage is greater than 5V (volts).

9. A plasma display device comprising:

a plasma display panel including a first electrode and a second electrode forming a discharge cell; and a driver for dividing a frame into a plurality of subfields having respective weights, driving the plurality of subfields, and alternately applying sustain discharge pulses to the first and second electrodes in a sustain period, wherein the first electrode comprises a first bus electrode, a first region formed within the discharge cell, and a second region for coupling the first region and the first bus electrode, wherein the second electrode comprises a second bus electrode, a third region formed within the discharge cell, and a fourth region for coupling the third region and the second bus electrode, wherein a width of the second region toward the direction of the first bus electrode is narrower than a length of the first region toward the direction of the first bus electrode, and wherein the voltage of the sustain discharge pulse in at least one subfield is different from the voltage of the sustain discharge pulse in another subfield, wherein the at least one subfield is a subfield with a low weight.

* * * * *